United States Patent [19]

Ermer et al.

[11] Patent Number: 4,777,926

[45] Date of Patent: Oct. 18, 1988

[54] DEVICE FOR CLAMPING THE BLADES IN A GANG SAW FOR SAWING CRYSTAL RODS

[75] Inventors: Wolfgang Ermer, Hirten; Karl Egglhuber, Hebertsfelden, both of Fed. Rep. of Germany

[73] Assignee: Heliotronic Forschungs -und Entwicklungsgesellschaft fur Solarzellen-Grundstoffe mbH, Burghausen, Fed. Rep. of Germany

[21] Appl. No.: 526,327

[22] Filed: Aug. 25, 1983

[30] Foreign Application Priority Data

Nov. 16, 1982 [DE] Fed. Rep. of Germany ..... 3242391

[51] Int. Cl.[4] ..... D28D 1/06

[52] U.S. Cl. ..... 125/17; 125/16 R

[58] Field of Search ..... 125/16 R, 17; 83/662; 52/223 R

[56] References Cited

U.S. PATENT DOCUMENTS 3,290,840 12/1966 Middendorf ..... 52/223 R 3,889,699 6/1975 Ranieri ..... 125/16 R

*Primary Examiner*—Frederick R. Schmidt

*Assistant Examiner*—Maurina Rachuba

*Attorney, Agent, or Firm*—Burgess, Ryan and Wayne

[57] ABSTRACT

A spacer for automatic parallel aligning and clamping of the blades in a gang saw which uses spacer plates which are trapezoidally enlarged toward their top and bottom edges. The supporting inner surface of the frame portion is designed as clamping mouth bevelled to fit the spacer configuration.

4 Claims, 2 Drawing Sheets

DEVICE FOR CLAMPING THE BLADES IN A GANG SAW FOR SAWING CRYSTAL RODS

The present invention is directed to a device for clamping the blades of a blade pack in a gang saw for sawing crystal rods into thin disks, having spacer plates arranged between the blades and power-coupled with them, which protrude beyond the blade width on both sides and are supported by their edges directed toward the working side on an inner face of a frame portion formed as a clamping mouth.

In the gang sawing of crystal rods, for example of silicon, germanium, gallium arsenide, sapphire, ruby or gallium-gadolinium garnet, rigid requirements are set for the geometry of the disks sawed from the rods. It is, for instance, possible to obtain exactly plane-parallel disks only if the single blades combined to form the blade pack are aligned exactly parallel in the gang saw.

From the Journal "Feinwerktechnik", 1962, No. 3, page 87, it is known to insert between the blades of a blade pack, spacers of equal thickness with plane-parallel contact surfaces, to ensure a plane-parallel arrangement. According to DE-PS No. 1217 261, rectangular spacer plates which protrude beyond the blade width on both sides and take support on the frame by their edges directed toward the working side, can be used. Such spacer plates are normally held by means of a pressure strip, in a fixed position, inside the spacer plate channel which is machined into the clamping frame, as illustrated in DE-PS No. 20 39 699. The danger is that the spacer plates will tilt and deflect the blades from an exactly parallel position and produce an unsatisfactory cut.

According to DE-OS No. 14 27 735, single blades and spacers can also be glued together to form blade packs. However, the exactly parallel gluing, pressing and grinding of the blade pack requires extremely careful working and moreover, involves additional cost and time.

BRIEF SUMMARY OF THE INVENTION

It is the object of the invention to provide a device whereby the blades of a blade pack can, in a simple manner, be clamped parallel in a gang saw which serves to saw crystal rods into thin disks.

This problem is solved by a device which comprises spacer plates widened in trapezoidal form toward their top and bottom edges, the top and bottom edges forming, with the edge directed toward the working side, an angle of about 40° to 75° and with the opposite edge, and angle of about 40° to 90° and that the supporting inner face of the frame portion designed as a clamping mouth, is bevelled to fit.

The configuration according to the invention causes the spacer plates automatically to move into a parallel position when the blade pack is clamped.

DETAILED DESCRIPTION OF THE INVENTION

The spacer plates need only have a trapezoidal enlargement toward the top and bottom edges at the edge directed toward the working side, while the opposite edge is straight and extends at right angles from the top edge to the bottom edge. It is preferred to provide a central-symmetrical configuration where both edges connecting the top edge with the bottom edge have symmetrical trapezoidal enlargements, because then an aligned placing on one of the spacer plates can be dispensed with, in particular, in automatic but also in manual assembling of the blade pack.

A configuration where only the portions of the spacer plates protruding beyond the blade width are trapezoidally enlarged toward the top and bottom edges has been found to be particularly advantageous. The contact surface preferably has a rectangular form so it is possible to obtain a good power-coupling connection between the spacer plates and the blades in the blade pack. Moreover, spacer plates thus formed are not susceptible to deformation by the tensile forces acting on them.

In the preferred gang saws, the spacer plates are located in the interior of the spacer plate channel which is formed by the upper and lower jaws of the frame portion designed as a clamping mouth and by the frame itself. The inner surface of the jaws directed toward the working side supports the edge of the spacer plates directed toward the working side as otherwwise, there is usually no contact between the spacer plates, clamping jaws, and saw frame.

It is preferred that the angle between the upper and lower edges of the spacer plate edge directed toward the working side, is between about 40° and 75°, preferably between about 60° and 70° and that the supporting inner surface of the clamping jaws is bevelled to fit so that the supported edge and the supporting surface are parallel. The smaller the deviation from parallelism—a few minutes of an angle may have an adverse effect—the more reliably will automatic alignment of the spacer plates and the blades be ensured.

The configuration according to the invention for the spacer plates and clamping mouth has the further advantage that tensile force exerted on the blades of the blade pack brings about a force which pulls the clamping jaws together and thus prevents the clamping mouth from expanding under the action of the tensile force.

Figure 1:
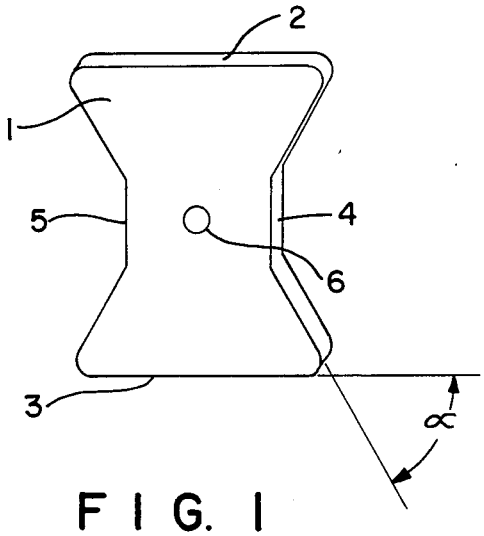
FIG. 1 illustrates an embodiment of a spacer plate having trapezoidal widening toward the top and bottom edges and forming equal angles between the sides and the top and bottom edges.
Figure 2:
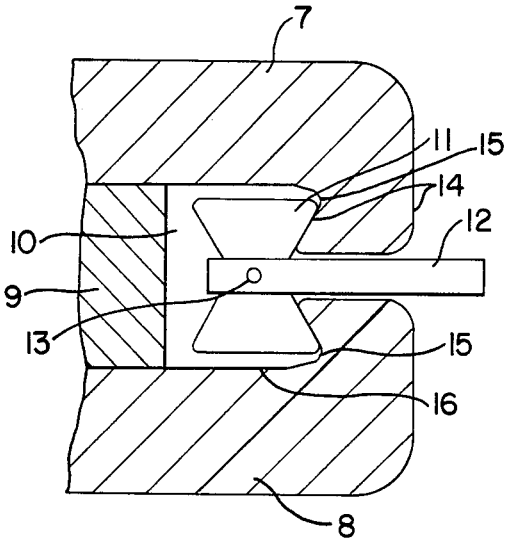
FIG. 2 is an illustration of a saw blade and spacer mounted in a spacer plate channel.

In FIGS. 1 and 2, possible forms of the spacer plates and clamping mouth according to the invention are illustrated to serve as models.

FIG. 1 shows spacer plate 1, which is trapezoidally widened in the direction of the top edge 2 and respectively, the bottom edge 3 in such a way that the edge 4 directed toward the working side or respectively, the opposite edge 5 forms with the top or bottom edge, an angle alpha. In the center, the spacer plate has a hole 6, which permits assembling a blade pack by alternate threading of spacer plates and blades on a suitable wire. The spacer plates used according to the invention are typically about 12 mm wide in the center, about 25 mm high, and about 0.4 mm thick; the angle alpha is about 70°. Suitably, the corners are rounded. Naturally, the stated general values serve only for illustration and not to limit the invention idea.

FIG. 2 shows a spacer plate channel 10 surrounded by top and bottom jaws 7 and 8 and saw frame 9. In the channel are located the spacer plate 11 and the end of the blade 12, which, like the spacer plate, has a hole 13. The spacer plate edge 14 directed toward the working side is supported on the jaw surface 15 bevelled parallel to the spacer plate edge 14. In a special design of the clamping jaws, their inner surfaces 16 are formed so that wholly or partly they extend toward each other at an angle of about 10° to 30°. Due to this configuration, the spacer plates move into the desired position more easily when traction is exerted on the blades. However, a design form where the inner surfaces 16 are parallel is also useful.

The device according to the invention makes it possible to easily clamp and align the blades of a blade pack in a gang saw as they automatically occupy the desired position in the clamping process. A considerable advantage resides in the fact that the spacer plates according to the invention can be inserted in a conventional gang saw after installation of the clamping jaws according to the invention. The clamping process as such can be left as described for example in the initially mentioned patent literature and as familiar to one skilled in the art.

Figure 3:
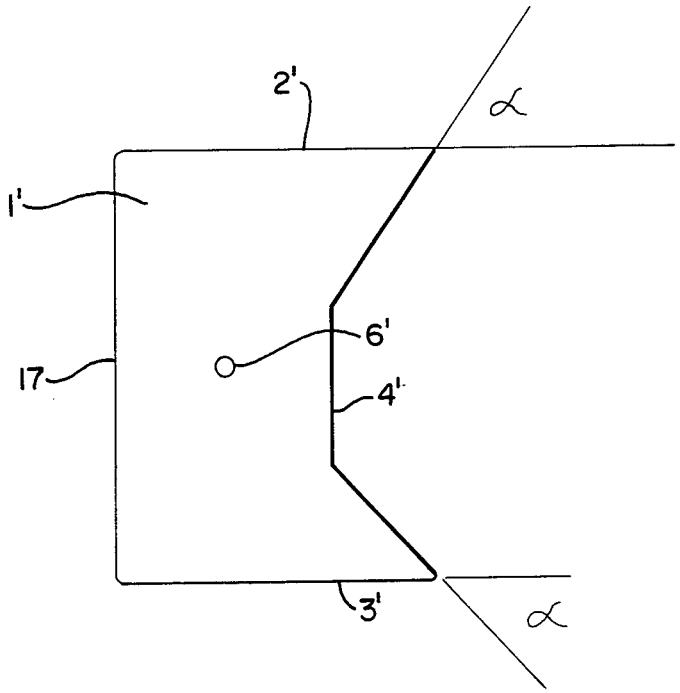
FIG. 3 illustrates an embodiment of a spacer plate having the edge opposite the working side forming an angle of 90° with the top and bottom edges and having a non central-symmetrical form.

FIG. 3 shows an alternative embodiment of a spacer plate 1' which is trapazoidally widened from working edge 4' toward top edge 2' and bottom edge 3' such that edge 4' forms an angle $\alpha$ with the top edge 2' and bottom edge 3'. The angle $\alpha$ is in the range between 40° and 75°. The opposite edge 17 forms an angle of 90° with top edge 2' and bottom edge 3'. The hole 6' is located centrally between top edge 2' and bottom edge 3', and parallel portions of edges 4' and 17.

What we claim is:

1. In a device for clamping the blades of a blade pack in a gang saw for sawing crystal rods into thin disks, spacer plates arranged between and power-coupled with the blades, each spacer plate including a top edge, a bottom edge, and opposing side edges formed between the respective top and bottom edges, each spacer plate extending above and below respective adjacent blades in the width-wise direction of said blades, at least a portion of one side edge of each spacer blade being in abutting relation against an inner face of a frame portion for the blades formed as a clamping mouth, said at least one portion of said one side edge being widened in a trapezoidal configuration toward the respective top and bottom edges, the top and bottom edges of each spacer plate forming with said one side edge thereof an angle in the range between 40° and 75°, and the opposite side edge forming with the top and bottom edges an angle in the range between 40° and 90°.

2. A device according to claim 1, wherein portions of the spacer plates protruding beyond the blade width are trapezoidally enlarged toward the top and bottom edges thereof.

3. A device according to claim 2 wherein the spacer plates have a central symmetrical form.

4. A device according to claim 1 wherein the spacer plates have a central-symmetrical form.

* * * * *